US006079501A

United States Patent [19]

Schmidt

[11] Patent Number: 6,079,501

[45] Date of Patent: Jun. 27, 2000

[54] OUTDOOR FIRE PREVENTION SYSTEM

[76] Inventor: Franklin D. Schmidt, 35680 Annapolis Rd., Annapolis, Calif. 95412

[21] Appl. No.: 09/145,821

[22] Filed: Sep. 2, 1998

[51] Int. Cl.[7] ..... A62C 3/02

[52] U.S. Cl. ..... 169/57; 239/230

[58] Field of Search ..... 169/54–57, 37; 239/230, 233

[56] References Cited

U.S. PATENT DOCUMENTS 1,898,482 2/1933 Doughty .
4,055,844 10/1977 Hornbostel, Jr. .
4,964,471 10/1990 Michalik et al. ..... 169/57
5,031,835 7/1991 Rojas ..... 239/230

*Primary Examiner*—Steven O. Douglas
*Attorney, Agent, or Firm*—Pillsbury Madison & Sutro LLP

[57] ABSTRACT

A fire prevention device that allows a fire prevention fluid obtained from a fluid source to flow therethrough when subject to a melting temperature includes a housing having a fluid inlet and a fluid outlet. A conduit is disposed between the fluid inlet and the fluid outlet, and a meltable material is disposed within the conduit. The meltable material sufficiently melts when subject to a temperature of at least the melting point of the meltable materials so that the fluid can exit via the conduit through the fluid outlet.

20 Claims, 9 Drawing Sheets

OUTDOOR FIRE PREVENTION SYSTEM

FIELD OF THE INVENTION

This invention relates generally to the field of automatic outdoor fire prevention systems and more specifically to an improved fire prevention or suppression device for use in automatic outdoor fire prevention systems.

BACKGROUND OF THE INVENTION

Each year many residential and commercial buildings are destroyed by fires. For example, brush fires and forest fires destroy residential areas, while industrial fires occur in various manufacturing facilities. Often, the structures which were destroyed by fire could have been saved if reliable automatic fire protection systems had been in place. Conventional systems that exist are typically overly complex and subject to failure, especially since they do not need to function except in the undesired emergency situation.

Various conventional fire suppression systems are described hereinafter. U.S. Pat. No. 5,165,482 to Smagac et al. discloses a fire deterrent apparatus including an infrared, ultraviolet or electro-optical fire detector to detect the presence of a fire in the immediate vicinity of a residential structure. The fire deterrent apparatus further includes an anemometer to measure the wind magnitude and direction at the home site as well as a plurality of sensors situated at various locations around a defined defensive perimeter to detect the ignition of fires within this defensive perimeter. A computer based controller is used to monitor the water level in a storage tank and to control the activation of a plurality of water delivery systems that function to apply water to the surrounding vegetation, to the roof or walls of the residential structure, and to any other site-specific locations that are required to prevent the ignition of a fire in the defensive perimeter. The computer based controller monitors the water supply, wind velocity, and the locus and direction of the fire to sequentially and periodically activate various water delivery systems when fire occurs.

U.S. Pat. No. 4,428,434 to Gelaude discloses an automatic fire protection system including a plurality of temperature sensors for monitoring the temperature of locations in a house or other structure. The sensors may read the actual air temperature of locations in a house. The system also includes sensors which react to radiant heat in order to detect a fire at some distance. When the sensors detect a given temperature, the sensors provide signals to a controlling circuit and mechanisms for actuating a plurality of sprinklers. A water line carries water from the water source through a pump and to the plurality of sprinklers on the house when the fire protection system is activated.

Each of the above referenced systems are extremely complex, requiring various sensors, power supply source, and additional electronic circuitry which couple the temperature sensors to the pump for pumping water from the water source to the sprinklers. Given this complexity, they are pre-disposed to failing in emergency conditions. For example, since they require electricity to operate, they will fail if electricity does not exist. A typical occurrence is when a spreading fire causes neighboring utility lines to be knocked down.

Thus, a simple and effective fire prevention system is needed.

SUMMARY OF THE INVENTION

The present invention advantageously provides an outdoor fire prevention system which is reliable, effective and yet relatively inexpensive and less difficult to implement as compared to conventional outdoor fire prevention systems.

The present invention also advantageously provides a fire prevention device which automatically suppresses fires and prevents fires from destroying residential homes or other structures.

The present invention also advantageously provides a fire prevention device for effectively soaking the more vulnerable portions of a structure or the area surrounding a structure prior to the arrival of a spreading fire.

The present invention advantageously provides a fire prevention system which can effectively suppress a spreading fire without the need for an electrical source or electrical control circuitry.

The present invention also advantageously provides an outdoor fire prevention system which is practical to implement in many environments and settings.

The present invention provides the above advantages, as well as others, through a fire prevention device that allows a fire prevention fluid obtained from a fluid source to flow therethrough when subject to a melting temperature. The fire prevention device includes a housing having a fluid inlet and a fluid outlet. A conduit is disposed between the fluid inlet and the fluid outlet, and a meltable material is disposed within the conduit. The meltable material sufficiently melts when subject to a temperature of at least the melting temperature so that the fluid can exit via the conduit through the fluid outlet.

DETAILED DESCRIPTION OF THE INVENTION

Those of ordinary skill in the art will realize that the following description of the present invention is illustrative only and not in any way limiting. Other embodiments of the invention will readily suggest themselves to those skilled in the art.

Figure 1A:
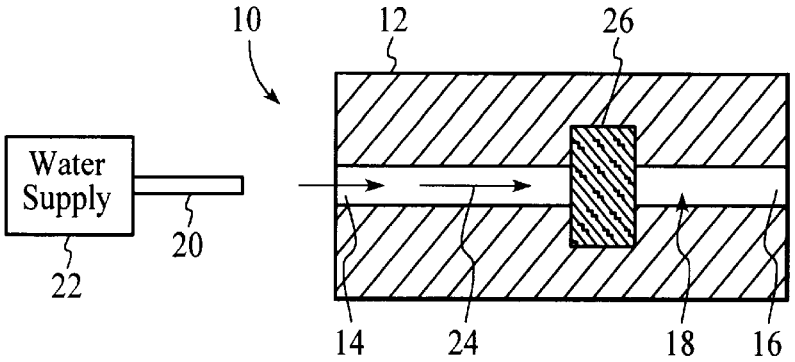
FIG. 1A is a cross section of a fire prevention device in accordance with a preferred embodiment of the present invention wherein a heat sensitive material (or fusible material) prevents fluid from exiting a fluid outlet.

Referring in detail now to the drawings wherein similar parts or steps of the present invention are identified by like reference numerals, there is seen in FIG. 1A a cross sectional view of fire suppression device 10 including a housing 12, a fluid inlet 14, and a fluid outlet 16. A conduit 18 is disposed within the housing 12 and between the fluid inlet 14 and the fluid outlet 16. A pressurized water supply pipe or hose 20, which is coupled to a water supply source 22, can be attached to the fluid inlet 14 so that a pressurized water stream 24 enters the conduit 18 via fluid inlet 14. In FIG. 1A, the pressurized water supply pipe 20 is shown as separated from the fluid inlet 14 in order to assist in explaining the function of the fire suppression device 10 in accordance with the present invention. The water supply source 22 may be a conventionally provided city water line, water tank or a private source of water from a well, stand pipe, pond, swimming pool, or water reservoir.

Figure 1B:
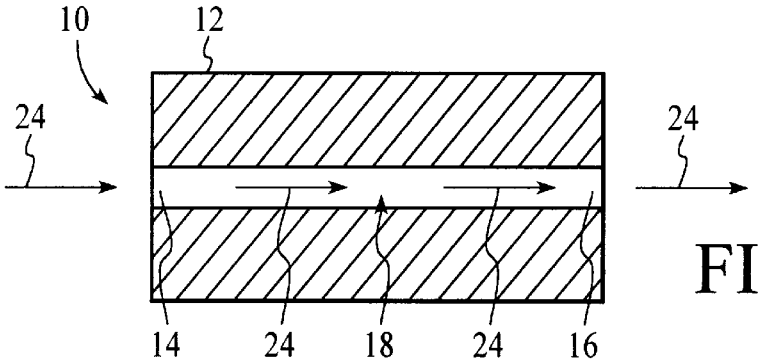
FIG. 1B is a cross section of the fire prevention device in FIG. 1A illustrating the melted heat sensitive material melts such that fluid exits the fluid outlet according to the present invention.

As shown in FIG. 1A, a plug or fusible material 26 is disposed in the conduit 18 to prevent the water stream 14 from exiting through the fluid outlet 16. In one preferred embodiment of the present invention, the plug 26 is constructed from wax. The wax, such as candle wax, will have a melting temperature, such as, for example, about 250–275 degrees Fahrenheit for candle wax, although the precise melting point will vary depending on the material from which plug 26 is made. Thus, when the air temperature in the vicinity of the fire suppression device 52 rises to the melting point, the plug 26 will melt or sufficiently dissolve, thereby permitting the water stream 24 to escape through opening 16 and suppress the source of heat or sufficiently water the surrounding area to prevent the spread of fire, as shown in FIG. 1B. At air temperatures below the melting point, the wax prevents the water stream 24 from exiting through the opening 16 by blocking the water stream 24 in the conduit 18. The plug 26 may be disposed in the conduit 18 by conventional methods of molding. For example, prior to completely assembling the fire prevention device 10, the plug 26 is molded inside the conduit 18.

In another embodiment in accordance with the present invention, the plug 26 may be constructed from other types meltable blocking agents, fusible materials, or eutectic materials which are heat sensitive and melt at predetermined temperatures, and also provide a good seal when in their unmelted state. The materials used for the plug 26 can be chosen based on the environment in which the fire suppression device 10 is placed. For example, if the fire suppression device 10 is used in a hot-climate region, the material for the plug 26 may be chosen to have a higher temperature melting point. If the fire suppression device 10 is used in cooler climates or coastal areas, then the material for the plug 26 may be chosen to have a melting point at lower temperatures. Melting points above 100 degrees, however, are preferable.

It is further noted that the fire suppression device 10 may be a separate component for providing fire prevention fluid for extinguishing fire. Alternatively, the fire suppression device 10 may incorporated in an existing device. Additionally, the number of plugs disposed within the conduit 18 and/or housing 12 may vary.

Figure 1C:
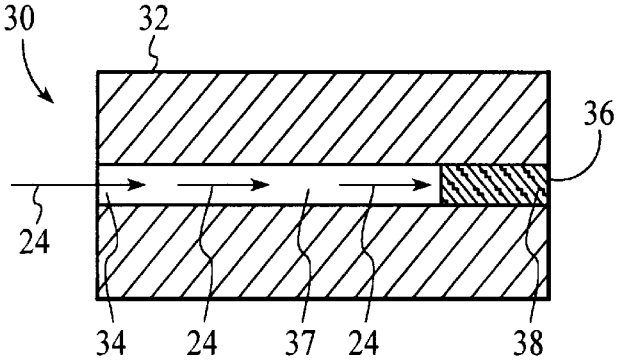
FIG. 1C is a cross section of a fire prevention device in accordance with another embodiment of the present invention.

Referring now to FIG. 1C, there is seen a fire suppression device 30 in accordance with another embodiment of the present invention. A housing 32 includes a fluid inlet 34 and a fluid outlet 36. The pressurized water stream 24 enters the conduit 37 via the fluid inlet 34, and a plug 38 positioned near the fluid outlet 36 prevents the water stream 24 from exiting through the fluid outlet 36 when the air temperature is below the melting point, about 250–275 degrees Fahrenheit if the plug 38 is constructed from candle wax. When the air temperature rises to the melting point, the plug 38 melts or permits the water stream 24 to exit through the fluid outlet 36. The plug 38 may be formed in the conduit 37 by conventional methods of molding. As a further alternative, the surface of the conduit 37 (near the fluid outlet 36 and on which the plug 38 is disposed) may be threaded to roughen the surface to prevent plug 38 from slipping out.

Figure 1D:
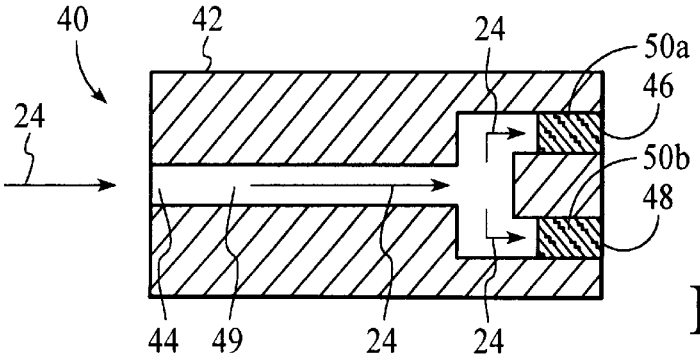
FIG. 1D is a cross section of a fire prevention device in accordance with another embodiment of the present invention.

In FIG. 1D, a fire suppression device 40 is shown in accordance with another embodiment of the present invention. The fire suppression device 40 includes a housing 42 with a fluid inlet 44, a fluid outlet 46, and a third opening 48. The pressurized water stream 24 enters the conduit 49 via the fluid inlet 44, and the plugs 50*a* and 50*b* positioned near the openings 46 and 48, respectively, prevent the water stream 24 from exiting through the second and third openings 46 and 48 when the temperature is below about 250–275 degrees Fahrenheit and if the plugs 50*a* and 50*b* are constructed from candle wax.

Figure 2:
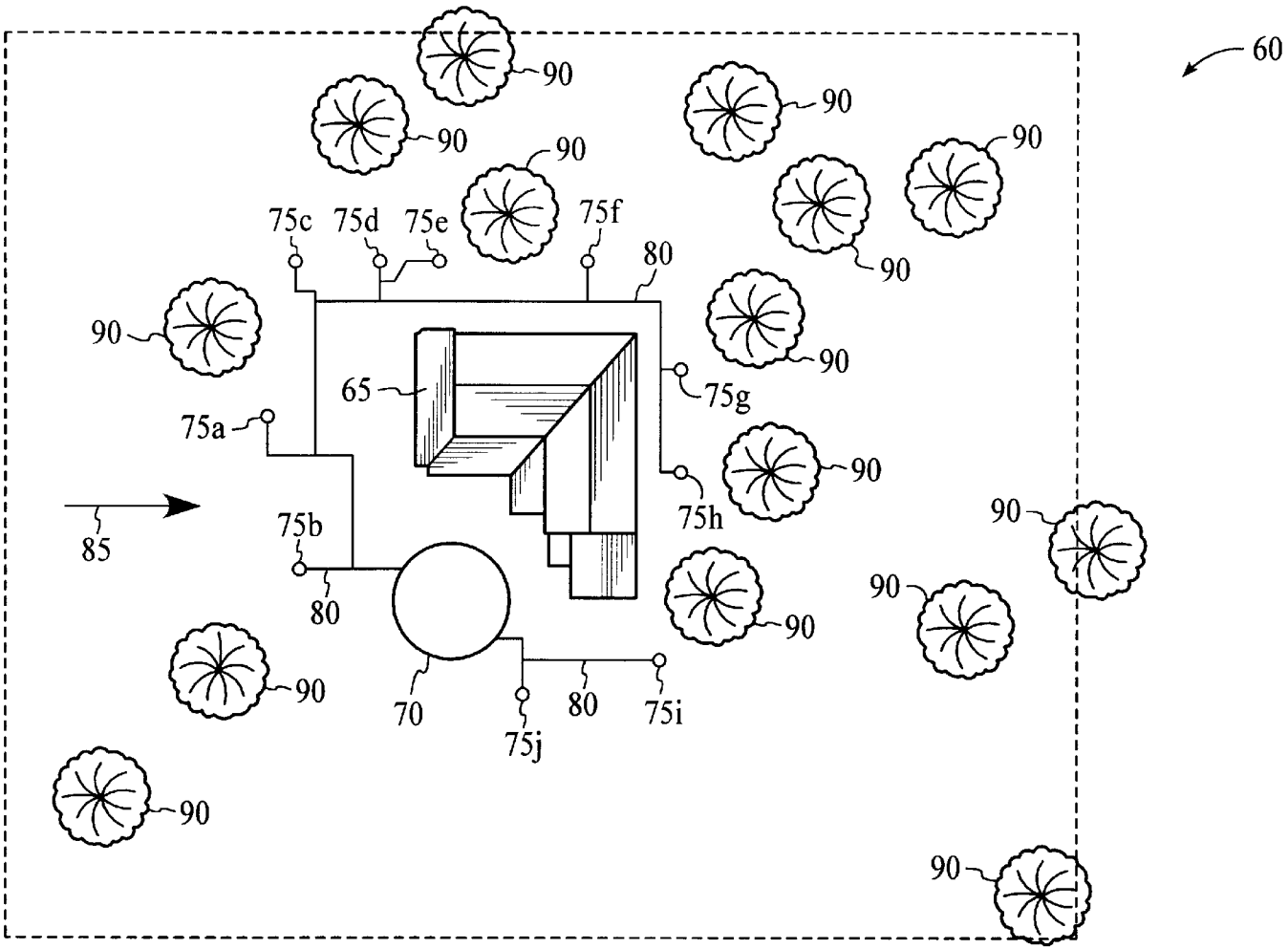
FIG. 2 is an aerial view of an environment which incorporates the fire prevention system in accordance with the present invention.

FIG. 2 is an aerial view of an environment which incorporates a fire protection system 60 in accordance with the present invention. A residential structure 65 is near a water source or tank 70 which stores a large quantity fire retardant fluid such as water. The fire protection system 60 includes a plurality of fire suppression devices 75*a*–75*j* which are similar to the devices described with reference to FIGS. 1A–1D and/or to the fire suppression devices described hereinbelow. The water source 70 provides water to the fire suppression devices 75*a*–75*j* via a plurality of pipes or other water conduits, generally illustrated as 80. The pipes 80 contain water which is under pressure at all times. When the temperature surrounding the fire suppression devices 75*a*–75*j* reaches a predetermined level, plugs (e.g., plugs 26, 36, 46 or 48, as described hereinabove with reference to FIG. 1) disposed in the suppression devices melt, thereby permitting the suppression devices 75*a*–75*j* to spray or disperse water for suppressing a fire. For example, the suppression devices 75*a* and 75*b* will actuate due to the heat caused by a spreading fire 85 and will disperse water for suppressing the spreading fire 85.

The fire suppression devices 75*a*–75*j* are kept under constant water-pressure, and thus only the fire suppression devices 7*a*–75*j* in which the plugs melt will turn on to suppress a fire.

The fire suppression devices 75*a*–75*j* are placed so as to spray the vegetation or area surrounding the residential structure 65 with water from the water source 70 to prevent the spread of fire. The fire suppression devices 75*a*–75*j* may also be chosen to spray the trees 90 in order to prevent airborne embers from igniting the trees. The fire suppression devices 75*a*–75*j* may also be chosen to direct a spray of the fire retardant fluid (e.g., water) on the roof, walls, decks, shrubbery etc. of the residential structure 65.

As stated above, the fire suppression devices 75*a*–75*j* automatically turn on to provide a spray of water when the surrounding temperature rises above a predetermined level that corresponds to the melting point of the plugging material. The fire suppression devices 75*a*–75*j* can soak various predetermined portions of the residential structure 65 or the area surrounding the residential structure 65 prior to the arrival of a spreading fire.

The fire prevention system 60 provides a cost effective and reliable fire protection system without the necessity of using computers, sensors, a power supply source, transducers, mechanical switching devices, and electronic circuits. Thus, the fire suppression system 60 is unlikely to fail in emergency conditions. For example, since the fire suppression system 60 is not dependent on electrical power, it is capable of suppressing fires even if electrical failure occurs in the area to be protected. In contrast, conventional fire suppression systems typically rely on sensors, electronic circuits, and electrical power for operation, and as a result, these systems will fail if a spreading fire causes neighboring utility lines to be knocked down.

Figure 3:
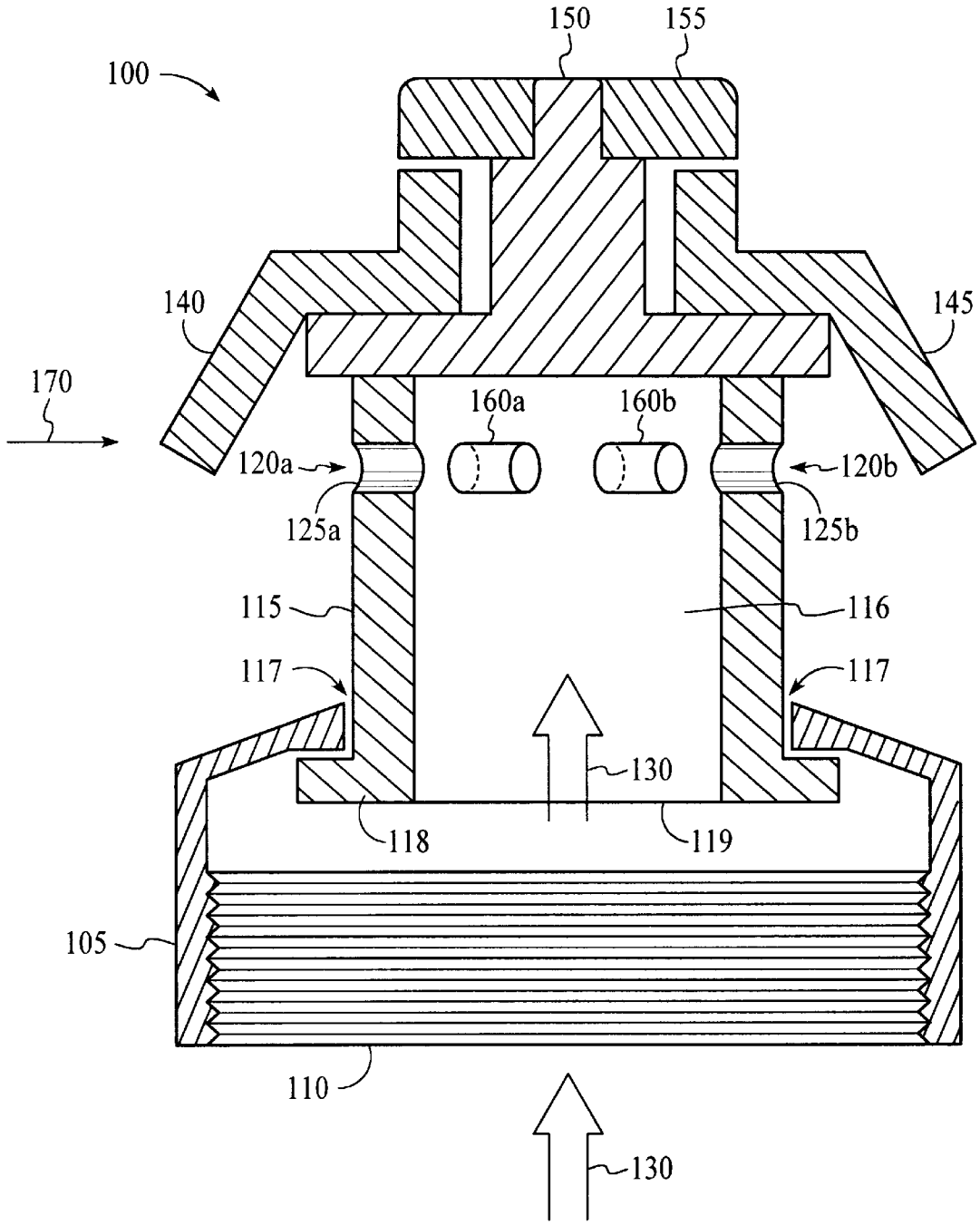
FIG. 3 is a cross section of another embodiment of a fire prevention device in accordance with the present invention.

FIG. 3 is a specific embodiment of an outdoor fire suppression or prevention device 100 in accordance with a preferred embodiment of the present invention. The fire suppression device 100 is, for example, a modified and improved brass impact-type rotary sprinkler. The fire suppression device 100 includes a mounting member 105 formed with internal threads 110 so that the mounting member is connected to a pressurized water supply pipe or hose (e.g., pipe 80 in FIG. 2). A nozzle (or housing) 115 is rotatably mounted to the mounting member 105. The nozzle 115 is formed with a hollow cylindrical section (conduit) 116 which is received within the mounting opening 117. The hollow cylindrical section 116 terminates in an annular flange 118. The fluid 130 is received by the mounting member 105 and through the fluid inlet 119 and in cylindrical section 116.

In the embodiment shown in FIG. 3, a pair of fluid outlets (orifices) 120*a* and 120*b* are formed in the nozzle 115. However, those skilled in the art will realize that the number of fluid outlets in the nozzle 115 can be varied. The fluid outlets 120*a* and 120*b* include the threaded surfaces 125*a* and 125*b*, respectively, and serve to discharge a water stream 130 which propagates through the hollow cylindrical section 116.

The fire suppression device 100 further includes a pair of rotary deflectors 140 and 145. A tip 150 receives a cap 155 for limiting the outward movement of the rotary deflectors 140 and 145. When the water stream discharges from the fluid outlets 120*a* and 120*b*, it impinges the rotary deflectors 140 and 145, thereby imparting a rotary movement to the rotary deflectors. The rotation of the rotary deflectors 140 and 145 causes the nozzle 115 to rotate about the mounting member 105.

It will be appreciated by those skilled in the art that many variations may be made in the fire suppression device 100. For example, the nozzle 115 may include only one (fluid outlet) orifice for discharging the water stream 130. Furthermore, the nozzle 115 may include only one impact member (e.g., impact member 140).

Figure 4:
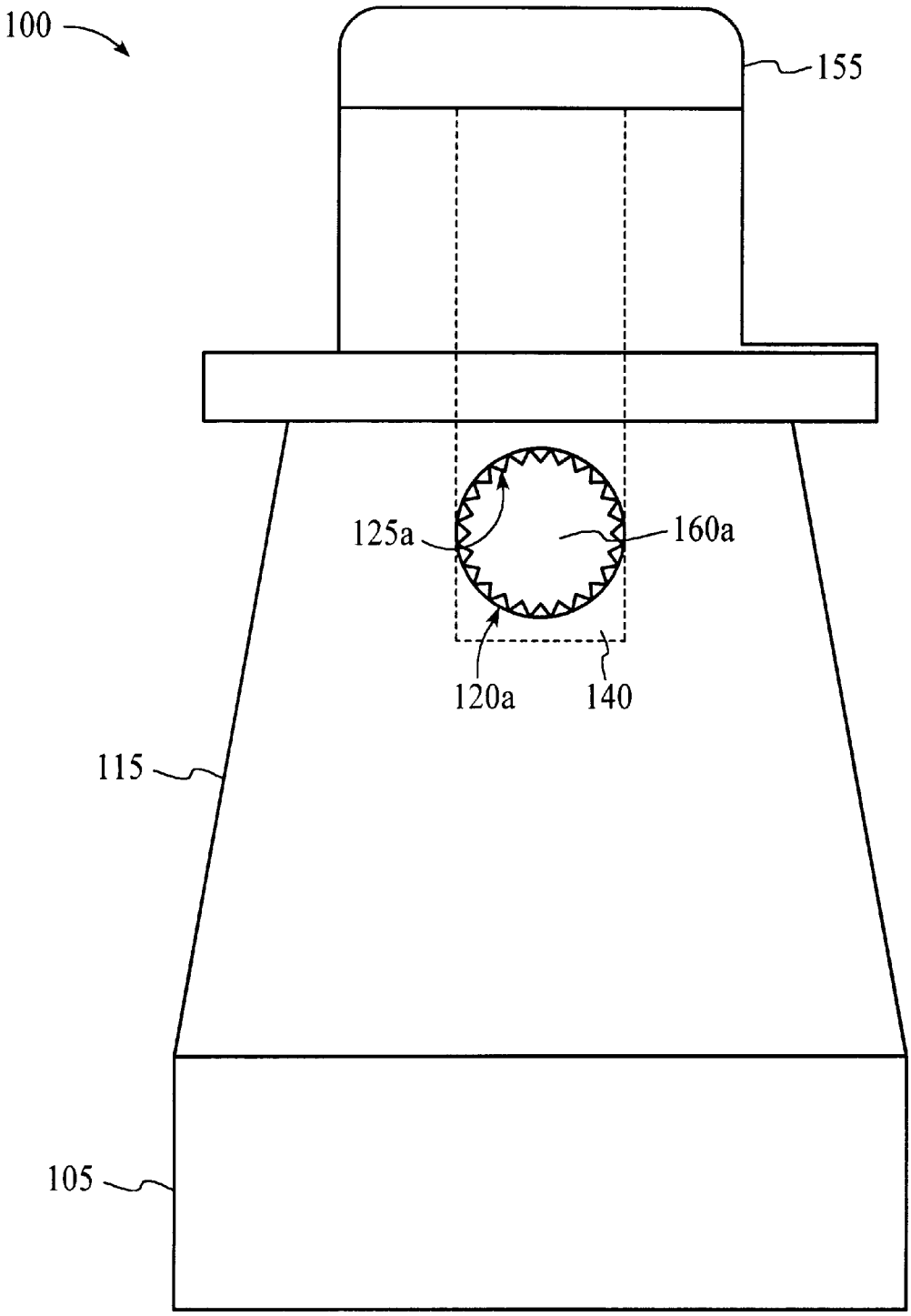
FIG. 4 is a side view of the fire prevention device of FIG. 3.

Plugs 160*a* and 160*b* are disposed within the fluid outlets 120*a* and 120*b*, respectively. In FIG. 3, the plugs 160*a* and 160*b* are shown as separated from the fluid outlets 120*a* and 120*b*, respectively, in order to assist in explaining the function of the fire suppression device 100 in accordance with the present invention. However, FIG. 4 shows the plug 160*a* disposed within the fluid outlet 120*a*, as seen in a side view looking in the direction of the arrow 170 in FIG. 3. In one preferred embodiment of the present invention, the plugs 160*a* and 160*b* are constructed from candle wax. Thus, when the air temperature in the vicinity of the fire suppression device 100 rises to, for example, about 250–275 degrees Fahrenheit as explained previously, the plugs 160*a* and 160*b* will melt, thereby permitting the water stream 130 to escape through the fluid outlets 120*a* and 120*b* to turn on the fire suppression device 100 and suppress the source of heater sufficiently water the surrounding area to prevent the spread of fire. At temperatures below about 250–275 degrees Fahrenheit, the candle wax prevents the water stream 130 from exiting through the fluid outlets 120*a* and 120*b*.

In another embodiment in accordance with the present invention, the plugs 160*a* and 160*b* may be constructed from other types meltable blocking agents, fusible materials, or eutectic materials which are heat sensitive and melt at predetermined temperatures. The materials used for the plugs 160*a* and 160*b* can be chosen based on the environment in which the fire suppression device 100 is placed. For example, if the fire suppression device 100 is used in a hot-climate region, the materials for the plugs 160*a* and 160*b* may be chosen to have a higher temperature melting point. If the fire suppression device 100 is used in cooler climates or coastal areas, then the materials for the plugs 160*a* and 160*b* may be chosen to have a melting point at lower temperatures.

Figure 5:
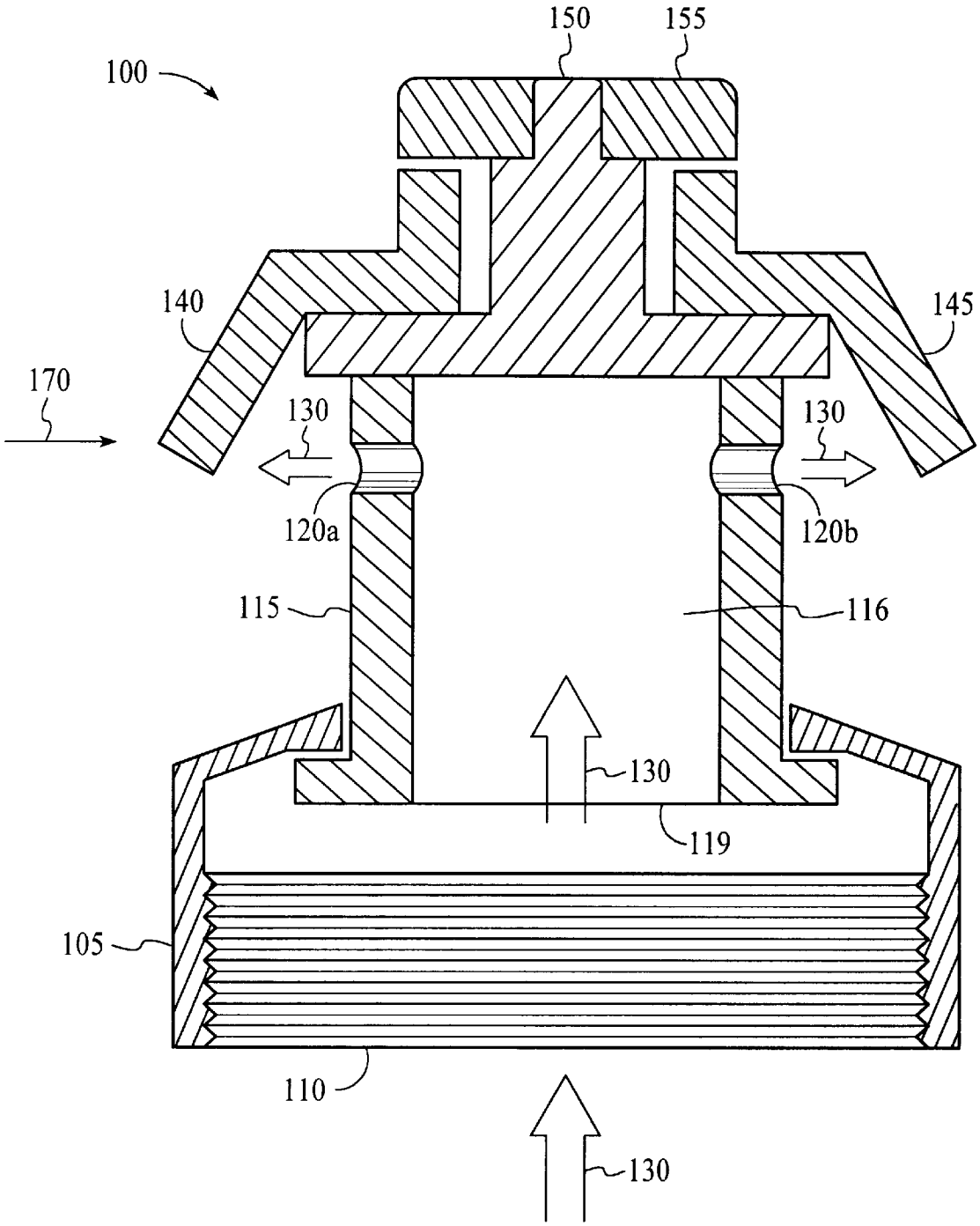
FIG. 5 is a cross section of the fire prevention device in FIG. 3 when the fire prevention device is actuated to provide liquid for suppressing fire.

Reference is now made to FIG. 5 for discussion of the operation of the fire suppression device 100. The mounting member 105 may be attached to a pressurized water supply pipe, hose or other conduit (e.g., pipe 80 in FIG. 2). Since the fire suppression device 100 is typically connected to an existing water line, it is able to utilize existing equipment and minimize added expense. The pressurized water stream 130 flows from a water source via the supply pipe to the hollow cylindrical section 116 of the fire suppression device 100. The water source may be a conventionally provided city water line, water tank or a private source of water from a well, stand pipe, pond, swimming pool, or water reservoir. A pressure reducer or restricter (not shown) can be placed in the water line leading from the water source to the fire suppression device 100. Thus, downstream of the pressure reducer, the water pressure is typically within the range of about 35 psi to about 75 psi. Additional pressure reducers or restricters (not shown) may be added downstream from the water source so that the pressure provided within the hollow cylindrical section 116 is typically within the range of about 48 psi to about 60 psi.

Assume the plugs 160*a* and 160*b* (FIG. 3) are inserted in the fluid outlets 120*a* and 120*b*, respectively, and are constructed from candle wax. At air temperatures below the melting point, about 250–275 degrees Fahrenheit, the plugs 160*a* and 160*b* remain solid and prevent the pressurized water stream 130 (in the hollow cylindrical section 116) from exiting through the fluid outlets 120*a* and 120*b*. When the air temperature rises above the melting point, the plugs 160*a* and 160*b* and the water stream 130 will exit from the fluid outlets 120*a* and 120*b*, as shown in FIG. 5.

The water stream 130 which exit from the fluid outlets 120*a* and 120*b* impinges against the rotary deflectors 140 and 145 so as to rotate the deflectors 140 and 145 as well as the nozzle 115. The rotary movement of the nozzle 115 will be in the form of stepped, intermittent movements, as in the conventional impact-rotary sprinkler.

Figure 6:
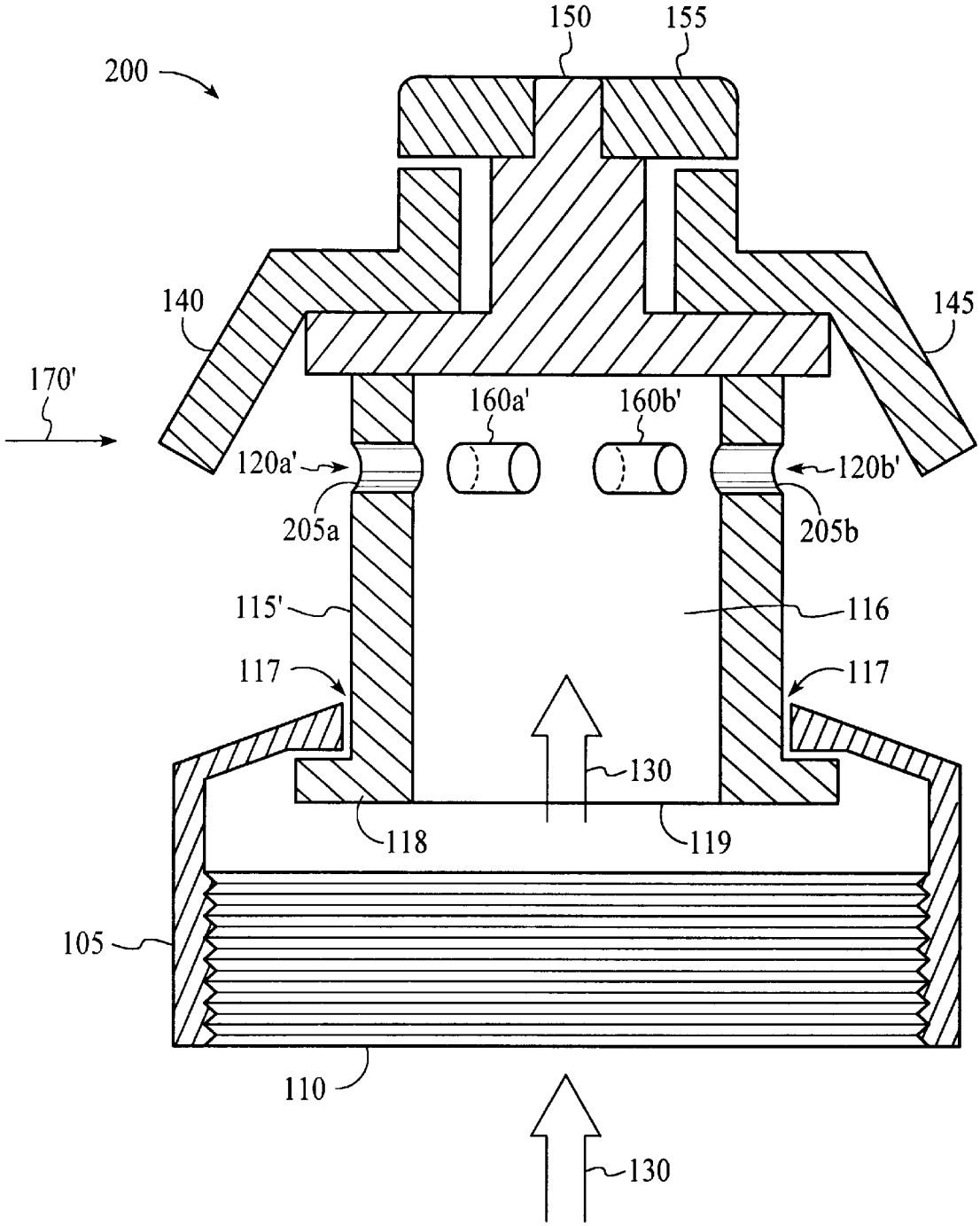
FIG. 6 a cross section of a fire prevention device in accordance with another embodiment of the present invention.
Figure 7:
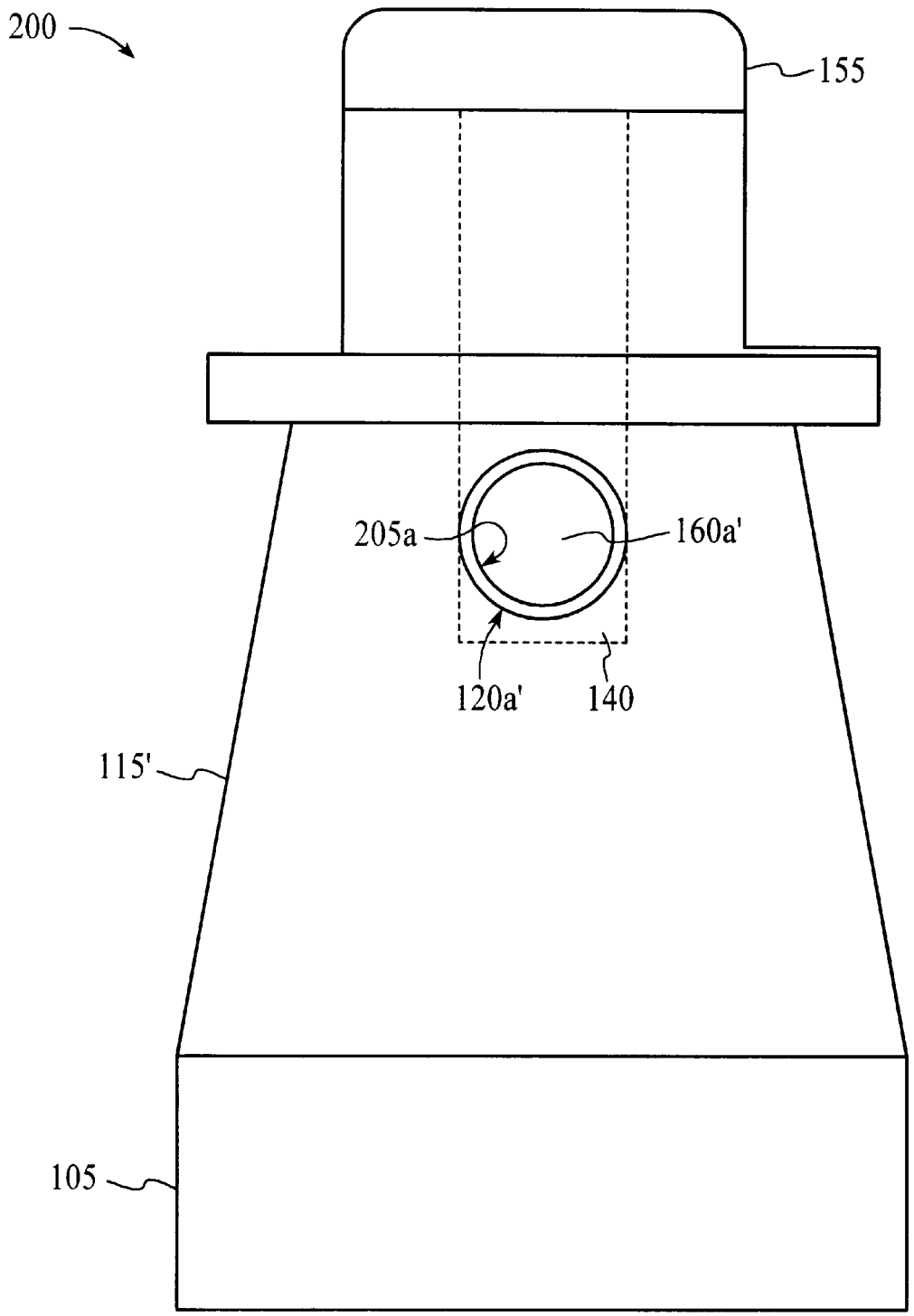
FIG. 7 is a side view of the fire prevention device of FIG. 6.

FIG. 6 shows a fire suppression device 200 in accordance with another embodiment of the present invention. The fluid outlets 120*a*' and 120*b*' are formed in the nozzle (or housing) 115' and include the non-threaded surfaces 205*a* and 205*b*, respectively. The other elements of the fire suppression device 200 are substantially the same as those described above with reference to FIG. 3. The plugs 160*a*' and 160*b*' are preformed into a particular shape and then subsequently inserted into the fluid outlets 120*a*' and 120*b*', respectively, to prevent the water stream 130 from exiting through the fluid outlets. In FIG. 6, the plugs 160*a*' and 160*b*' are shown as separated from the fluid outlets 120*a*' and 120*b*', respectively, in order to assist in explaining the function of the fire suppression device 200 in accordance with the present invention. However, FIG. 7 shows the plug 160*a*' disposed within the fluid outlet 120*a*', as seen in a side view looking in the direction of the arrow 170' in FIG. 6. The plugs 160*a*' and 160*b*' may be constructed from materials which melt at a predetermined temperature or in the presence of fire.

Figure 8:
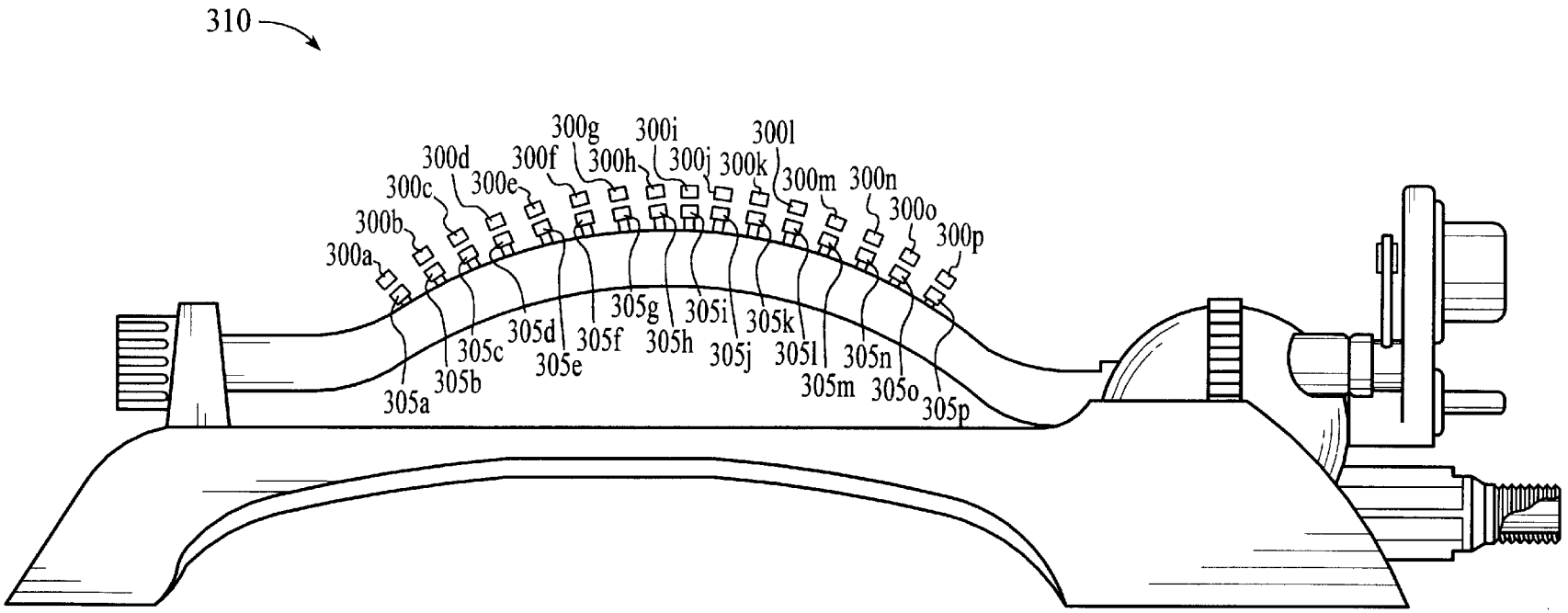
FIG. 8 is a perspective view of a fire prevention device in accordance with another embodiment of the present invention.

Those skilled in the art will realize that, based upon the teachings of the present invention, other types of sprinklers or sprinkler heads may be modified so as to incorporate the features of the present invention. For example, various impact-type rotary sprinklers, other types of rotary sprinklers, and/or bridge-type sprinklers may be modified to incorporate the features of the present invention. Also, it is within the scope of the present invention to provide a plurality of meltable plugs in the fluid outlets of a conventional oscillating lawn sprinkler so that the lawn sprinkler automatically actuates in the event of fire. In FIG. 8, for example, a plurality of fusible materials or plugs 300*a*–300*p* are placed in the fluid outlets (final orifices) 305*a*–305*p*, respectively, of an oscillating lawn sprinkler 310.

Figure 9:
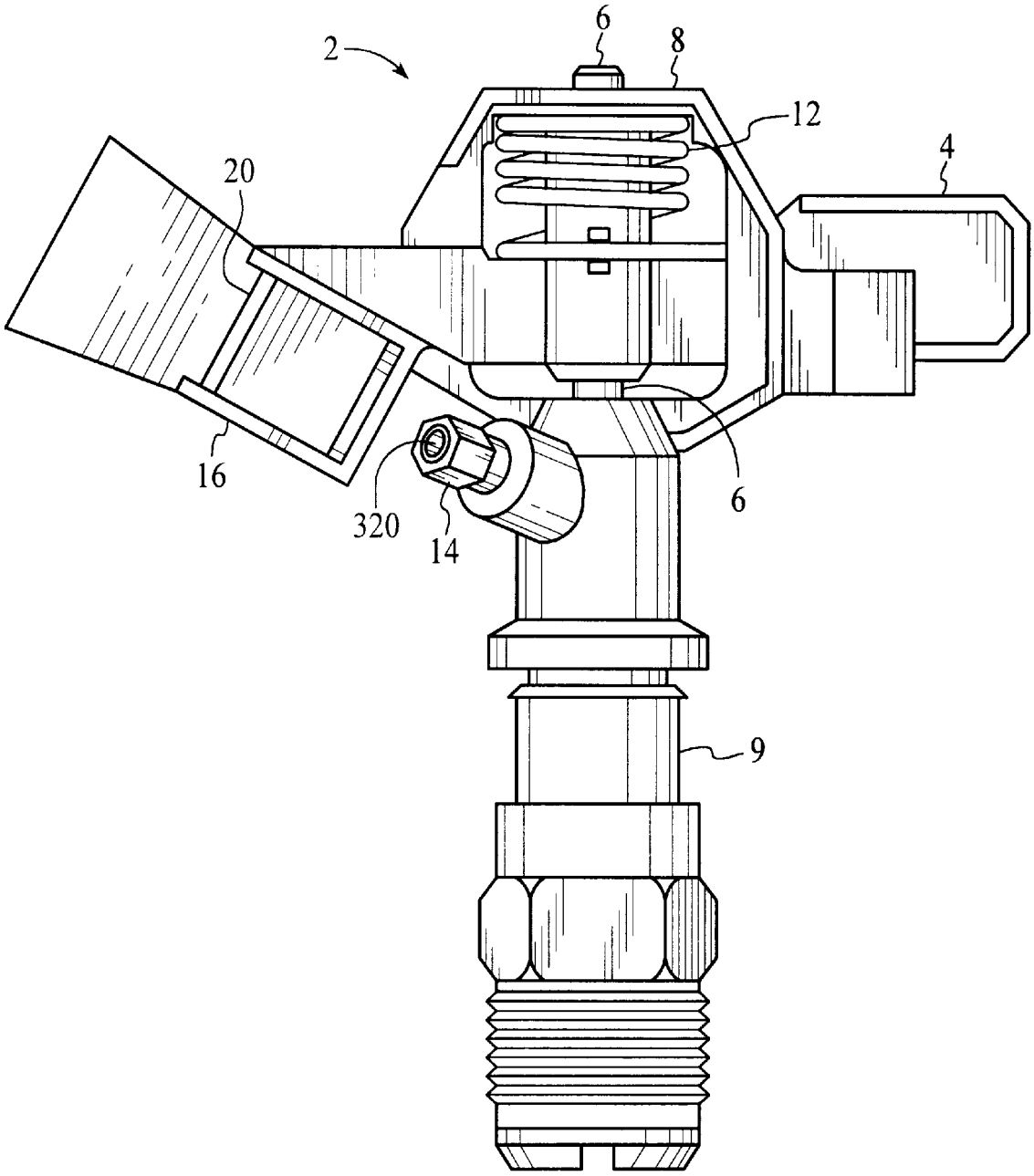
FIG. 9 is a perspective view of a fire prevention device in accordance with another embodiment of the present invention

In FIG. 9 is shown a preferred fire prevention device using a brass impact-type rotary sprinkler, which device has similarities to that described above with respect to FIG. 3, but also illustrates the other components of the brass impact type rotary sprinkler that can be used in combination with the present invention. The brass impact-type rotary sprinkler illustrated in FIG. 9 is modified from FIG. 1 of U.S. Pat. No. 5,031,835, which patent is hereby expressly incorporated by reference. FIG. 9 has been modified to include a plug 320 of the type described above within the near nozzle 14 of the sprinkler 2, as described in the '835 patent, and is illustrated in the state that in which the plug 320 prevents fluid from being expelled therefrom. Of course, the sprinkler 2 as illustrated in FIG. 9 can be modified further to include other features of the present invention, as noted above.

In addition, it is within the scope of the present invention to provide a plurality of meltable plugs in the fluid outlets of a seeper hose or other conduits which in effect serve as sprinkler devices. Thus, it is understood that the fire prevention device in accordance with the present invention includes all types of apparatuses that would apply water to an object in a manner and volume desirable for the stated purpose. Furthermore, the fire suppression device in accordance with the present invention may be adapted for use in various environments and effectively provide protection against the spread of fire.

Thus, while the present invention has been described herein with reference to particular embodiments thereof, a latitude of modification, various changes and substitution are intended in the foregoing disclosure, and it will be appreciated that in some instances some features of the invention will be employed without a corresponding use of other features without departing from the scope of the invention as set forth.

What is claimed is:

1. An outdoor fire prevention device that allows a fire prevention fluid obtained from a fluid source to flow therethrough onto an area adjacent to a property to be protected from fire, comprising:

a housing having a fluid inlet intended to be coupled to the fluid source and a fluid outlet, the housing being a rotary sprinkler that provides a rotating sweep of the fluid across the area;

a conduit disposed between the fluid inlet and the fluid outlet; and a meltable material having a melting point disposed within the conduit, the meltable material preventing the flow of fire prevention fluid therethrough at temperatures below the melting point and sufficiently melting when subject to a temperature above the melting point so that the fluid can exit via the conduit through the fluid outlet onto the area.

2. The fire prevention device of claim 1 wherein the meltable material comprises wax.

3. The fire prevention device of claim 2 wherein the meltable material comprises candle wax.

4. The fire prevention device of claim 1 wherein the meltable material has a melting point above 100 degrees Fahrenheit.

5. The fire prevention device of claim 1 wherein the impact rotary sprinkler is made of brass.

6. The fire prevention device of claim 5 wherein the brass impact rotary sprinkler further includes a pair of rotary deflectors.

7. The fire prevention device of claim 5 wherein the conduit has an edge that abuts the fluid outlet, and the edge of the conduit is threaded to assist in maintaining the meltable material in position at temperatures below the melting point.

8. The fire prevention device of claim 7 wherein the meltable material comprises candle wax.

9. The fire prevention device of claim 1 wherein the conduit has an edge that abuts the fluid outlet, and the edge of the conduit is threaded to assist in maintaining the meltable material in position at temperatures below the melting point.

10. An outdoor fire prevention system that applies a fire prevention fluid from a fluid source when portions of the system are subjected to temperatures above a melting point onto an area adjacent to a property to be protected from fire, comprising:

a plurality of fire prevention devices disposed adjacent to the property and each having a meltable material having a melting point that prevents fire prevention fluid from being expelled from each fire prevention below the melting point, the meltable material within each of the plurality of fire prevention devices melting when subjected to a temperature of at least the melting point so that the fire prevention fluid is expelled therefrom onto a portion of the area; and a plurality of pipes for coupling the fire prevention devices to the fluid source.

11. The fire prevention system of claim 10 wherein each of the fire prevention devices includes:

a fluid inlet for receiving the fire prevention fluid and a fluid outlet for dispersing the fire prevention fluid; and a conduit disposed between the fluid inlet and the fluid outlet for supporting the meltable material; and wherein the plurality of fire prevention devices surround the area.

12. The fire prevention system of claim 11 wherein the meltable material comprises wax.

13. The fire prevention device of claim 12 wherein the meltable material comprises candle wax.

14. The fire prevention device of claim 10 wherein the meltable material has a melting temperature above 100 degrees.

15. A method for protecting a designated outdoor area from fire comprising the steps of:

providing a plurality of fire prevention devices in the designated area, each of the plurality of fire prevention devices coupled to a fire prevention fluid source and including a meltable material having a melting point that prevents the fire prevention fluid from being expelled at temperatures below the melting point; and coupling each of the plurality of fire prevention devices to a fire prevention fluid source; and subjecting one of the plurality of fire prevention devices to heat that exceeds the melting point resulting from the fire, the meltable material sufficiently melting and causing the fire prevention fluid to be dispersed therefrom onto a portion of the designated outdoor area, thereby assisting in extinguishing the fire upon contact with the fire prevention fluid.

16. The method of claim 15 further comprising the step of:

subjecting another one of the fire prevention devices to heat that exceeds the melting point resulting from the fire so that the meltable material in the another one of the fire prevention devices sufficiently melts and the fire prevention fluid is dispersed by the another one of the fire prevention device.

17. The method of claim 16 wherein the step of providing provides a plug of a meltable material that is inserted into the conduit and the conduit contains a threaded portion that assists in maintaining the plug in position at temperatures below the melting point.

18. The method of claim 15 wherein the step of providing provides wax as the meltable material.

19. The method of claim 18 wherein the step of providing provides candle wax as the meltable element.

20. The method of claim 15 wherein the step of providing provides a plug of a meltable material that is inserted into a conduit.

* * * * *